US005382208A

United States Patent [19]

Hu

[11] Patent Number: 5,382,208

[45] Date of Patent: Jan. 17, 1995

[54] MAGNETIC-RESISTANCE CONTROL DEVICE FOR AN EXERCISE BICYCLE

[76] Inventor: Hui-Hsin Hu, 4th Fl., No. 48-3, Sec. 3, Tien Chin Rd., Pei Tun Dist., Taichung, Taiwan, Prov. of China

[21] Appl. No.: 204,873

[22] Filed: Mar. 2, 1994

[51] Int. Cl.[6] ..... A63B 69/16; A63B 21/24

[52] U.S. Cl. ..... 482/63; 482/61; 482/903

[58] Field of Search ..... 482/57, 903, 61, 63, 482/1, 4–7, 60

[56] References Cited

U.S. PATENT DOCUMENTS

| | | | |
|---|---|---|---|
| 4,752,066 | 6/1988 | Housayama | 482/903 |
| 5,076,573 | 12/1991 | Lo | 482/903 |
| 5,094,447 | 3/1992 | Wang | 482/903 |

FOREIGN PATENT DOCUMENTS

| | | | |
|---|---|---|---|
| 1279201 | 6/1972 | United Kingdom | 482/903 |

*Primary Examiner*—Stephen P. Crow

*Attorney, Agent, or Firm*—Holland & Hart; Ralph F. Crandell

[57] ABSTRACT

A magnetic-resistance control device for an exercise bicycle includes a platform connected with a base. A flywheel axle is rotatably mounted above the platform and is engaged with a rear wheel of the bicycle to rotate in an opposite direction thereof. A flywheel is made of magnetism-conducting material and is mounted to the flywheel axle for rotating therewith. A bracket is mounted on the platform. A U-shaped permanent magnet is slidably engaged on the bracket and defines an opening in which the flywheel is partly enclosed. The flywheel interacts with magnetic flux generated by the magnet when rotated such that a magnetic force is exerted on the flywheel, thereby generating a resistance to the flywheel. A driving device is provided for driving the magnet to reciprocate relative to the flywheel.

6 Claims, 3 Drawing Sheets

MAGNETIC-RESISTANCE CONTROL DEVICE FOR AN EXERCISE BICYCLE

BACKGROUND OF INVENTION

1. Field of Invention

The present invention relates to a magnetic-resistance control device, and more particularly to a magnetic-resistance control device for an exercise bicycle.

2. Related Prior Art

A conventional magnetic-resistance control device for an exercise bicycle comprises a flywheel axle engaged with a rear wheel of the bicycle to rotate in an opposite direction thereof. A flywheel is mounted to the flywheel axle for rotating therewith, A U-shaped permanent magnet defines an opening in which the flywheel is partly enclosed. The flywheel interacts with magnetic flux generated by the magnet when the flywheel rotates such that a magnetic force is exerted on the flywheel, thereby generating a constant resistance on the flywheel.

By such an arrangement, there is provided a constant resistance to the rear wheel of the exercise bicycle during the exercise process, however it is monotonous and tedious to a user such that the user is not able to obtain a better exercise effect.

The present invention has arisen to mitigate and/or obviate the afore-mentioned disadvantages of the conventional magnetic-resistance control device for an exercise bicycle.

SUMMARY OF THE INVENTION

The primary objective of the present invention is to provide a magnetic-resistance control device for an exercise bicycle.

Another objective is to provide a magnetic-resistance control device which is able to generate a varying and adjustable resistance to changeably retard the rotation of a rear wheel of the exercise bicycle such that a user is able to obtain a better exercise effect.

In accordance with one aspect of the present invention, there is provided a magnetic-resistance control device for an exercise bicycle comprising a platform connected with a base. A flywheel axle is rotatably mounted above the platform and is engaged with a rear wheel of the bicycle to rotate in an opposite direction thereof. A flywheel is made of magnetism-conducting material and is mounted to the flywheel axle for rotating therewith. A bracket is mounted on the platform, A U-shaped permanent magnet is slidably engaged on the bracket and defines an opening in which the flywheel is partly enclosed. The flywheel interacts with magnetic flux generated by the magnet when the flywheel rotates such that a magnetic force is exerted on the flywheel, thereby generating a resistance to the flywheel. A driving device is provided for driving the magnet to reciprocate relative to the flywheel.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
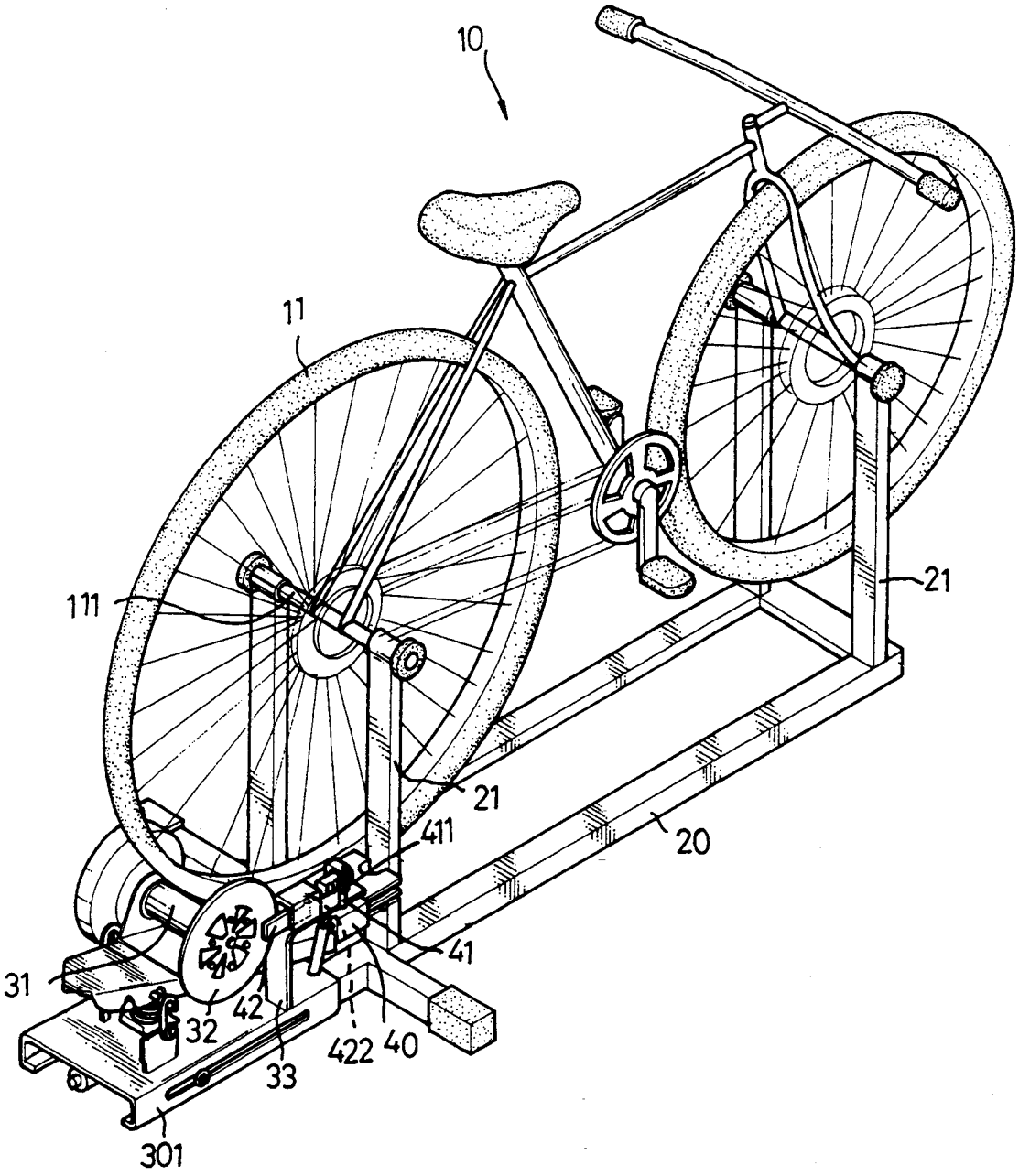
FIG. 1 is a perspective view of a magnetic-resistance control device for an exercise bicycle in accordance with the present invention.
Figure 2:
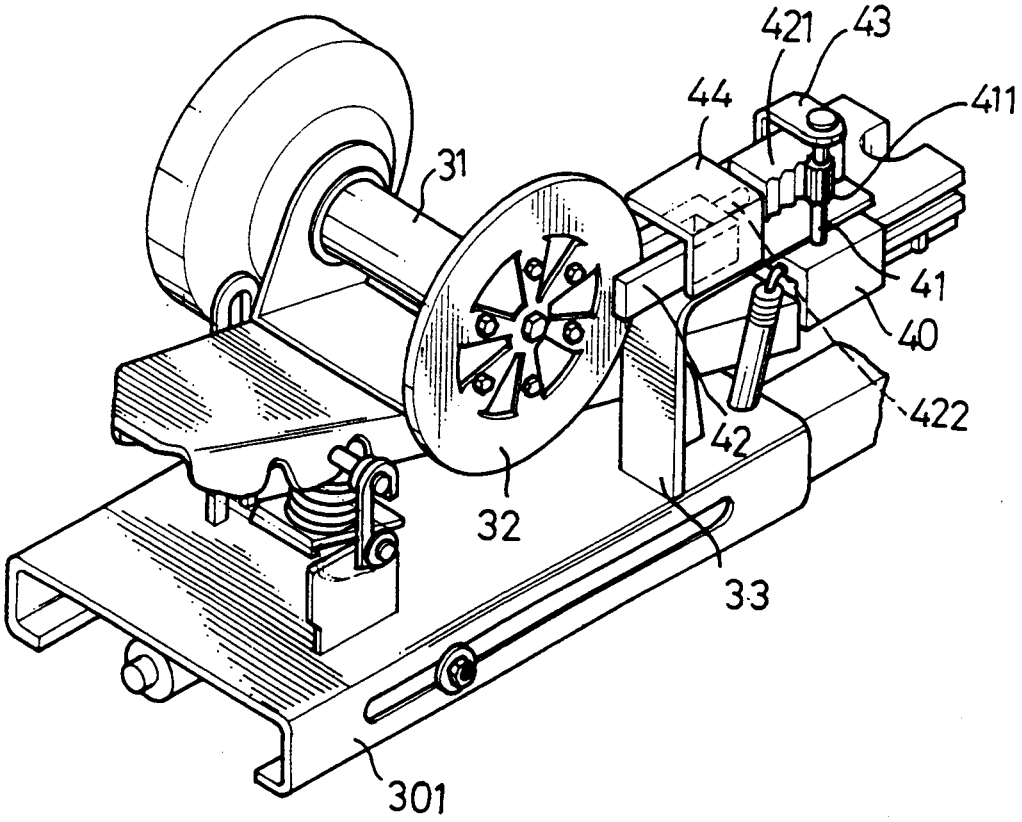
FIG. 2 is an enlarged perspective view of the magnetic-resistance control device as shown in FIG. 1.
Figure 3:
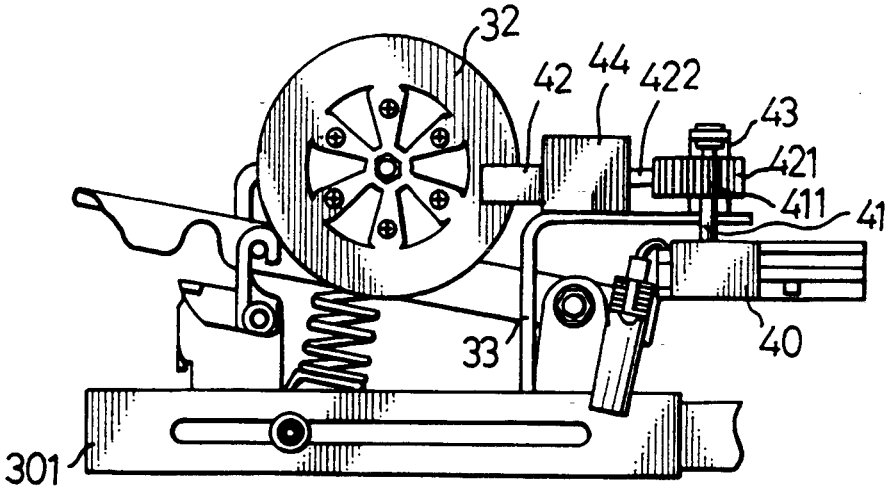
FIG. 3 is front plan view of the magnetic-resistance control device as shown in FIG. 2.
Figure 4:
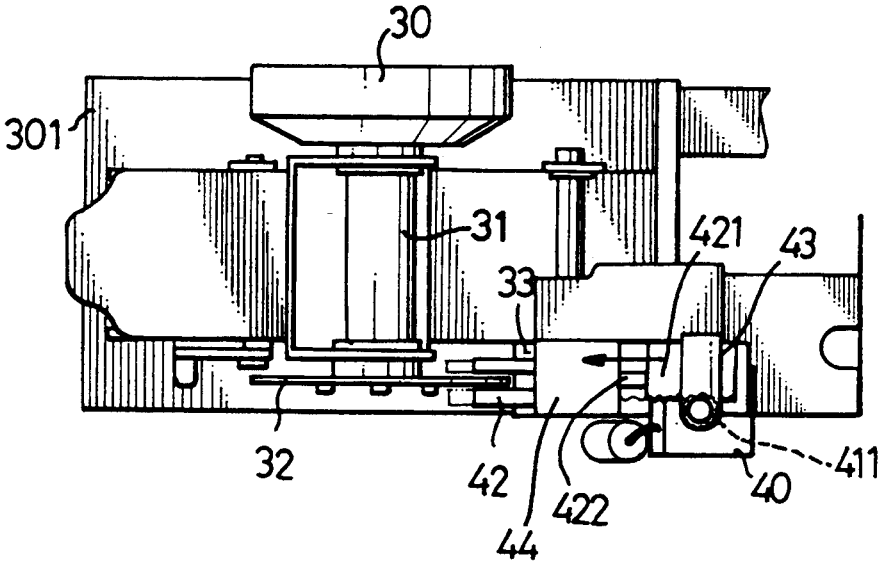
FIG. 4 is top plan view of the magnetic-resistance control device as shown in FIG. 2.

Referring to the drawings, a magnetic-resistance control device in accordance with the present invention is provided for an exercise bicycle 10. The bicycle 10 has a front wheel and a rear wheel 11 respectively rotatably mounted around a front axle and a rear axle 111. A base 20 has two pairs of vertical extensions 21 extending upwardly therefrom for respectively supporting the front axle and rear axle 111 of the bicycle 10.

The magnetic-resistance control device comprises a platform 301 connected to the base 20. A flywheel axle 31 is rotatably mounted above the platform 301 by a supporting means and is engaged with the rear wheel 11 to rotate in an opposite direction thereof. A flywheel 32 is made of magnetism-conducting material, preferably ferrite material, and is mounted to the flywheel axle 31 for rotating therewith. An L-shaped bracket 33 is mounted on the platform 301. A U-shaped permanent magnet 42 is slidably engaged on the bracket 33 and defines an opening in which the flywheel 32 is partly enclosed.

The flywheel 32 interacts with magnetic flux generated by the magnet 42 when the flywheel rotates such that a magnetic force is exerted on the flywheel 32, thereby generating a resistance to the flywheel 32.

A driving means is provided for driving the magnet 42 to reciprocate relative to the flywheel 32. The driving means comprises a linking rod 422 extending from the U-shaped permanent magnet 42. A rack 421 is disposed-on the bracket 33 and is coupled to the linking rod 422. A motor 40 is mounted to an underside of the bracket 33 and has a shaft 41 which is mounted in a pinion 411 for rotating the pinion 411 and extends upwardly therefrom. The pinion 411 meshes with the rack 421 for driving the rack 421 to move the magnet 42 to reciprocate relative to the flywheel 32.

An L-shaped limiting element 43 connects with the L-shaped bracket 33 and abuts against the rack 421 for limiting the rack 421 to slide along a straight direction, thereby restricting the U-shaped permanent magnet 42 to reciprocate relative to the flywheel 32 along a straight direction. The L-shaped limiting element 43 has a distal end for securely supporting the shaft 41 of the motor 40.

It is to be noted that a cover 44 is mounted on the bracket 33 for enclosing and protecting the permanent magnet 42.

In operation, the flywheel 32 rotates with the flywheel axle 31 synchronously in an opposite direction of the rear wheel 11 and is partly enclosed in the opening of the U-shaped permanent magnet 42 so as to continuously interact with magnetic flux generated by the magnet 42, thereby generating a resistance on the flywheel 32, thus retarding the rotation of the rear wheel 11. The pinion 411 is rotated by the motor 40 for driving the rack 421 to move the magnet 42 to reciprocate relative to the flywheel 32.

When the motor 40 operates at a constant rate, the magnet 42 reciprocates relative to the flywheel 32 at a constant speed, thereby generating a stably changed resistance on the flywheel 32 so as to uniformly retard the rotation of the rear wheel 11. In addition, when the motor 40 operates at a variable rate, then the magnet 42 reciprocates relative to the flywheel 32 at a varying speeds, thereby generating an unstably changed resistance on the flywheel 32 so as to retard the rotation of the rear wheel 11 in various resistance levels. Further, when the motor 40 stops operating, there is no relative motion between the flywheel 32 and the magnet 42, so the resistance to the rear wheel 11 is retained constantly.

Accordingly, by such an arrangement, the magnetic-resistance control device for an exercise bicycle in accordance with the present invention is able to provide a varying and adjustable resistance to changeably retard the rotation of a rear wheel of the exercise bicycle such that a user is able to obtain a better exercise effect.

It should be clear to those skilled in the art that further embodiments of the present invention may be made without departing from the teachings of the present invention.

I claim:

1. A magnetic-resistance control device for an exercise bicycle (10) which has a front wheel and a rear wheel (11) respectively rotatably mounted around a front axle and a rear axle (111), a base (20) having two pairs of vertical extensions (21) extending upwardly therefrom for respectively supporting the front and rear axles (111), said magnetic-resistance control device comprising:

a platform (301) connected with said base (20);

a flywheel axle (31) rotatably mounted above said platform (301) and engaged with said rear wheel (11) rotate in an opposite direction thereof;

a flywheel (32) made of magnetism-conducting material and mounted to said flywheel axle (31) for rotating therewith;

a bracket (33) mounted on said platform (301);

a U-shaped permanent magnet (42) slidably engaged on said bracket (33) and defining an opening in which said flywheel (32) is partly encircled, said flywheel (32) interacting with magnetic flux generated by said magnet (42) when said flywheel (32) rotates such that a magnetic force is exerted on said flywheel (32), thereby generating resistance to said flywheel (32); and means for driving said magnet (42) to reciprocate relative to said flywheel (32).

2. The magnetic-resistance control device in accordance with claim 1, wherein said flywheel (32) is made of ferrite material.

3. The magnetic-resistance control device in accordance with claim 1, further comprising a cover (44) mounted on said bracket (33) for enclosing said permanent magnet (42).

4. The magnetic-resistance control device in accordance with claim 1, wherein said driving means comprises:

a linking rod (422) extending from said U-shaped permanent magnet (42);

a rack (421) disposed on said bracket (33) and coupled to said linking rod (422);

a pinion (411) meshing with said rack (421) for driving said rack (421) to move said magnet (42) to reciprocate relative to said flywheel (32); and a motor (40) mounted to said bracket (33) and having a shaft (41) which is mounted in said pinion (411) for rotating said pinion (411).

5. The magnetic-resistance control device in accordance with claim 4, further comprising a limiting element (43) abutting against said rack (421) for limiting said rack (421) to slide along a straight direction.

6. The magnetic-resistance control device in accordance with claim 5, wherein said limiting element (43) has a L-shaped configuration with a distal end connected with said shaft (41) of said motor (40) for supporting said shaft (41).

* * * * *